US006826788B1

(12) United States Patent
Ricke

(10) Patent No.: US 6,826,788 B1
(45) Date of Patent: Dec. 7, 2004

(54) SINK ANCHORING SYSTEM

(76) Inventor: James Ricke, 770 Hawthorne La., West Chicago, IL (US) 60185

( * ) Notice: Subject to any disclaimer, the term of this patent is extended or adjusted under 35 U.S.C. 154(b) by 0 days.

(21) Appl. No.: 10/440,622

(22) Filed: May 19, 2003

(51) Int. Cl.[7] ..... E03C 1/33
(52) U.S. Cl. ..... 4/633
(58) Field of Search ..... 4/631–634; 312/140.4

(56) References Cited

U.S. PATENT DOCUMENTS 2,883,677 A * 4/1959 Geen ..... 4/636
3,354,474 A * 11/1967 Rokitenetz et al. ..... 4/633

* cited by examiner

*Primary Examiner*—Charles E. Phillips
(74) *Attorney, Agent, or Firm*—Gregory B. Beggs

(57) ABSTRACT

An improved assembly is disclosed for clamping the perimeter flange of a sink snugly down upon a countertop where the sink is being installed. The assembly utilizes a stud extending downwardly from the underside of the perimeter flange and a link connected to the stud having a displacement member, such as a threaded bolt, which engages the underside of the countertop adjacent the hole in the countertop where the sink is located. As the displacement member is manipulated against the underside of the countertop, the link holding the displacement member draws the stud downwardly to pull the flange snugly against the upper face of the countertop adjacent the sink installation hole.

10 Claims, 2 Drawing Sheets

SINK ANCHORING SYSTEM

This invention relates to anchoring sinks in countertops through apertures which have been formed there to receive them. More particularly, it relates to utilizing an elongated stud anchored, as by welding, to the underside of a flange surrounding the sink and a locking link engaged on the body of the stud. When the link is forced away from the countertop, as by turning a bolt which extends from the link to engage the underside of the countertop, the stud, and the sink flange portion to which it is joined, are moved downwardly past the countertop, and the flange of the sink is drawn downwardly by the stud to a point where it is fastened against the upper side of the countertop.

BACKGROUND OF THE INVENTION

Sink anchoring systems are generally summed up in U.S. Pat. No. 4,613,995. Sink bowls are conventionally held in an opening in a countertop by way of mounting brackets spot-welded, for example, to the lower surface of the bowl flange overlapping the opening, the brackets being provided with apertures through which are passed fasteners, such as wood screws driven into the countertop material at the edge of the opening, or through the bottom surface of the countertop proximate the edge of the opening. The mounting brackets may be in the form of separate bracket elements welded at convenient locations, or in the form of a molding strip, the brackets being L-shaped in some installations and U-shaped in other installations. Other methods of securing a sink bowl in a countertop opening have been devised which avoid driving fasteners, such as wood screws, into the material of the countertop. Such alternate methods generally use clamping arrangements formed integrally with the mounting brackets, including threaded members passed through appropriate threaded apertures in the bracket engaging the surface of the countertop, generally the lower surface proximate the edge of the opening, and holding the sink bowl in position by pulling the bowl flange edge into engagement with the top surface of the countertop proximate the opening.

The fastening system in the '995 patent incorporates an upside down L-shaped angle-iron strip welded to the underside of the sink bowl flange. A C-shaped clamp has a top leg which nests into a runner along the toe of the angle-iron strip. The bottom leg of the C-shaped clamp is pierced to accommodate a threaded member whose head is below and outside of the C-shape of the clamp. A rim portion of a countertop aperture intrudes into the middle of the C-shape of the clamp, at which point the threaded member can be turned so that it will engage the underside of the rim portion. As the threaded member is turned and thrust against the rim portion, the top leg of the C-shaped clamp drags the L-shaped bracket, and the sink flange to which the bracket is welded, into firm contact with the upper side of the counter top rim portion.

Another fastening system is illustrated in U.S. Pat. No. 6,021,532, issued Feb. 8, 2000. In that system, too, a channel member is fastened to the underside of a perimeter flange around a sink. In the '532 patent the channel member has an inverted U-shaped cross section. The depending legs of the channel are formed with upwardly facing shoulder members which are situated inside the channel opposite each other. A pin with a conical head extends into the channel so that the underside of the shoulders of the cone engage the shoulder members on the channel legs. When the pin is drawn downwardly, it pulls the U-shaped channel, and the sink flange to which it is affixed, to engage the flange on the upper side of a countertop. The pin has a second conical head, opposite the head inside the channel which is fixed in a base unit with an annular face. A series of flat surfaces which increase gradually in height around the annular face provide an increasing circumferential thickness of the base unit. The annular face engages the underside of the countertop adjacent the aperture for the sink, and when the base unit is turned, the pin with the conical heads has its upper end drawn down onto the shoulders of the channel thereby drawing the sink flange to which the channel is attached down against the upper side of the countertop.

The present invention does not require the material or the tooling which the constructions in the above-described patents call for, and it also avoids the much more exact tolerances which the prior constructions demanded. The elements of the present invention are easier to handle and assemble, and they are faster to install

SUMMARY OF THE INVENTION

The present invention is embodied in an assembly which includes a countertop that has a portion of its surface arranged for installing a sink. There is an aperture in that portion for the sink to be dropped into, and there is a rim portion of the countertop located around the aperture. A perimeter flange on the sink overlies the rim portion when the sink is disposed in the aperture. Studs depend from the sink's perimeter flange. Each stud has a first end secured to the perimeter flange, a distal end adjacent the underside of the countertop, and a body portion in between the ends. A link located between the stud and the rim portion of the countertop has a first end portion extending toward the underside of the countertop rim portion and a stud engagement portion disposed on the body portion of the stud. A displacement means located on the first end portion of the link is simultaneously moveable against the underside of the countertop rim portion and the first end portion of the link. When the displacement means is moved against these elements, the link moves the stud downwardly through the aperture passing it past the rim portion of the countertop and drawing the sink flange to which the stud is fastened into secure engagement with the upper side of the countertop rim portion.

From the foregoing, and from what follows, it will be apparent that the present invention solves a need for a less expensive way to fasten a sink securely in place in a countertop.

Accordingly, it is one of the objects of this invention to provide a sink clamping assembly in a countertop installation utilizing a stud affixed to and depending from the underside of a perimeter flange on the sink.

It is another object of this invention to provide a sink clamping assembly in a countertop installation in which a stud member depending from a flange on the sink is readily grasped around its midportion by a link which, when moved away from the countertop, pulls the stud through the aperture in which the sink is positioned and draws the flange on the sink against the upper side of the countertop.

It is another object of this invention to eliminate an expensive engagement means such as a welded rail or a welded track on the underside of the sink's perimeter flange and to provide an easier, less demanding engagement member attached to the flange.

It is another object of this invention to provide a sink flange and countertop engagement having less sophisticated, lower cost parts than prior combinations which have been offered.

Other objects and features of this invention will be apparent to those skilled in the practical art of installing and attaching sinks in countertops as well as to those skilled in the art of designing and manufacturing sink-to-countertop attachment mechanisms, especially after an examination of the following detailed description of the preferred embodiments of the present invention and of the accompanying drawings.

DESCRIPTION OF THE PREFERRED EMBODIMENTS

The preferred embodiments of this invention shown in the accompanying drawings will now be described, it being understood that the preferred forms are illustrative and that the invention described herein is embodied in the claims which are appended hereto.

Figure 1:
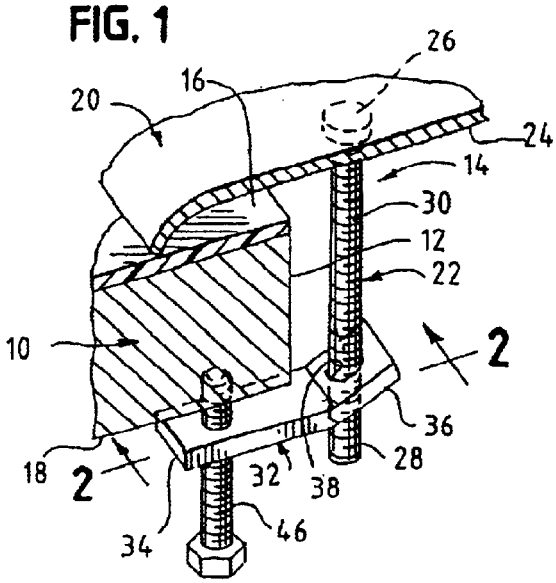
FIG. 1 is a perspective view, partly in section and partly broken away, of a portion of a countertop to which a perimeter flange of a sink is secured on its upper side by a stud attached to the underside of the flange.

In FIG. 1 a countertop 10 has a rim portion 12 extending toward an aperture 14 in which a sink (not shown) may be installed. The upper side of the countertop rim portion is designated at 16 and the underside of the countertop rim portion is designated at 18. The sink is provided with a perimeter flange 20, part of which overlies the upper side of the countertop rim portion, so that when the flange rests on the countertop rim portion, the sink bowl is suspended in aperture 14. A stud 22 is affixed, as by welding, to the underside 24 of perimeter flange 20 adjacent to the upper side 16 of the countertop rim portion. The first end 26 of the stud is affixed to the flange, the distal end 28 of the stud extends adjacent to the underside 18 of the countertop rim portion, and the body portion 30 of the stud is situated between first end 26 and the distal end 28.

Figure 2:
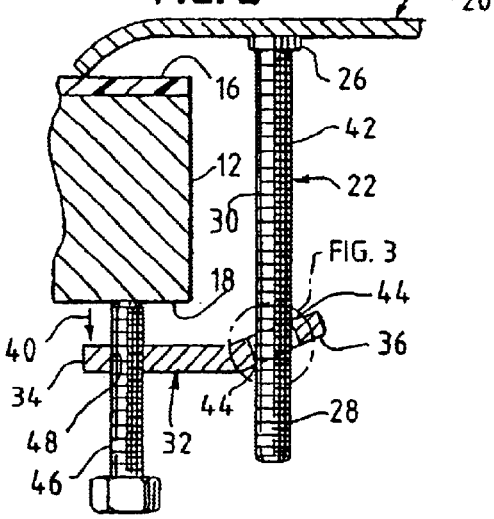
FIG. 2 is an elevational view, partly in section, of the sink flange and countertop assembly in FIG. 1 taken in the direction of arrows 2—2 in FIG. 1.
Figure 3:
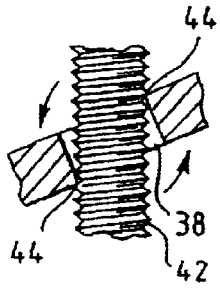
FIG. 3 is an enlarged view of a portion of FIG. 2 designated by the dotted line circle labeled FIG. 3 in FIG. 2.

As shown in FIG. 1, a link 32 is located intermediate the underside 18 of the countertop rim portion and the stud 22. The link includes a first end portion 34 which extends from the stud toward the underside of the countertop rim portion and also includes a stud engagement portion 36 which is slideably disposed on the body portion 30 of stud 22. Particularly as shown in FIGS. 1–3, the stud engagement portion of the link 32 may be constructed of a flat strip of metal with a hole 38 through it and bent at a slight upward angle from the rest of the link. The hole 38 is slightly larger in diameter than the body portion 30 of the stud so that the stud engagement portion 36 can be slipped easily onto the stud's body portion 30. When the link is tilted, as indicated by arrow 40 in FIG. 2, the edges 44 of the walls in the link around hole 38 engage and lock the link onto the stud's body portion 30 as shown in FIG. 3. Preferably, the stud is externally threaded, as illustrated, with threads 42 which the edges of the walls around hole 38 will readily and firmly engage when the link is tilted away from a horizontal orientation as shown in FIGS. 2 and 3.

A displacement means such as bolt 46 is engaged in an internally threaded aperture 48 formed in the first end portion 34 of the link. Bolt 46 is located so that when it is turned it will come into contact with the underside 18 of the countertop 10. As the bolt is turned further on its threads and those in the walls of aperture 48, it moves against the underside of the countertop and the first end portion 34 of link 32 simultaneously, forcing the link further and further away from the countertop and forcing the stud grasped by the link downwardly, moving it along past the rim portion 12 of the countertop. Such movement of the stud 32 draws the perimeter flange 20 of the sink into secure engagement with the upper side 16 of the countertop rim portion 12.

Figure 4:
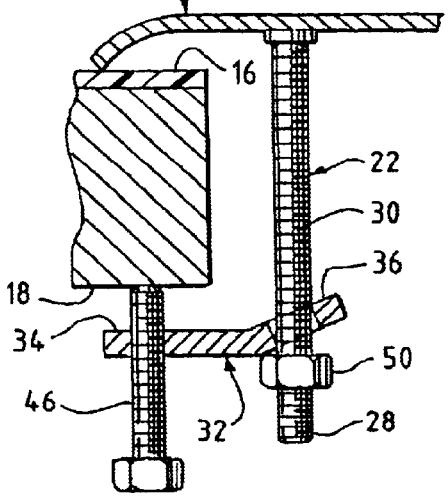
FIG. 4 is an elevational view, partly in section, of a modified version of the sink flange and countertop assembly shown in FIG. 2.

If desired, the engagement of link 32 on stud 22 may be enhanced in the manner shown in FIG. 4. A nut or similar stop member 50 is threaded onto the distal end 28 of the bolt 22 and rotated until it is adjacent the stud engagement portion 36 of link 32. If the walls 44 forming the hole 38 are spaced too far apart, so that the edges 44 cannot be counted upon to engage the body portion 30 of the stud 22, the nut 50 can be relied upon to intercept and engage the link whenever the bolt 46 is manipulated to draw the stud downward and engage the sink flange 20 onto the countertop. It may also be preferable to use the nut 50 regularly in combination with the rest of the clamp elements shown in FIGS. 1–3 due to the fact that manipulating nut 50 can positively position link 32 and bolt 46 on the stud 22 to take up any slack in the chain of elements and insure that turning the bolt 46 accomplishes a secure flange engagement on the upper surface of the countertop rim portion.

Figure 5:
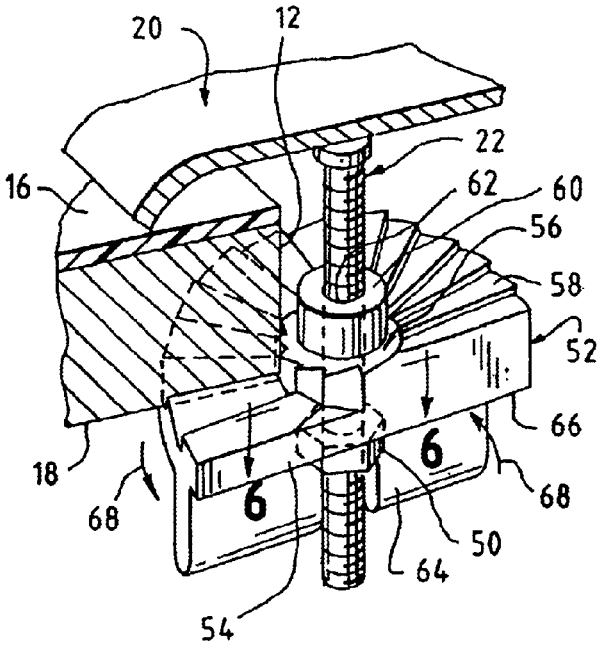
FIG. 5 is a perspective view, partly in section, of an alternative embodiment of the invention shown in FIG. 4 utilizing a second form of linkage between the stud attached to the sink flange and the underside of the countertop.

A further embodiment of this invention is shown in FIG. 5. In this figure, the sink flange 20, the stud 22 and the countertop rim portion 12 (with upper side 16 and underside 18) are the same elements illustrated in the preceding FIGS. 1–4. Link 52, however, takes on a different form from that shown in the preceding figures. The body of link 52 includes a first or outer end portion 54 and an inner stud engagement portion 56. The outer end portion 54 is circularly formed as a washer which can be rotated around the stud 22. On one face of the washer, illustrated as the upper face, there is a circumferentially ascending surface portion 58 which may be formed as a radiating set of steps, as illustrated, or as an inclined ramp. Such a surface acts as a displacement means when the link 52 is rotated around stud 22.

Figure 6:
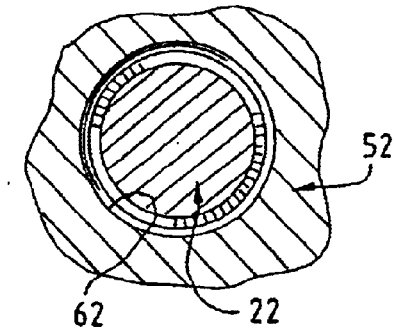
FIG. 6 is a sectional view, partly broken away and enlarged, of a portion of the assembly shown in FIG. 5 taken in the direction of arrows 6—6 in FIG. 5.

Link 52 includes a core portion 60 which is centrally located in link 52 and has a tubularly apertured section 62 for engaging the link on the body portion 30 of stud 22. As illustrated in FIGS. 5 and 6, the tubularly apertured section 52 is not and need not be internally threaded for engagement on the stud 22, and a nut such as nut 50 may be threaded onto stud 22 below the link 52 to hold the link at one point or another on the body portion of the stud. Tabs 64 or similar means easily grasped in a craftsman's fingers are attached to lower face 66 of link 52 so that the link can be easily assembled onto the stud and so that the link can be rotated around the stud without any need for a tool.

In use, link 52 is placed onto stud 22 and the nut 50 turned enough to bring the ascending surface portion 58 of the link into contact with the underside 18 of the countertop rim portion 12. Then, by holding tabs 64 and rotating link 52 in the direction of arrows 68, the displacement of the link and stud achieved by moving the ascending surface portion 58 against the underside 18 of the countertop rim portion draws the stud past the countertop rim portion and draws the sink flange 20 securely down onto the upper side 16 of the countertop rim portion.

Figure 7:
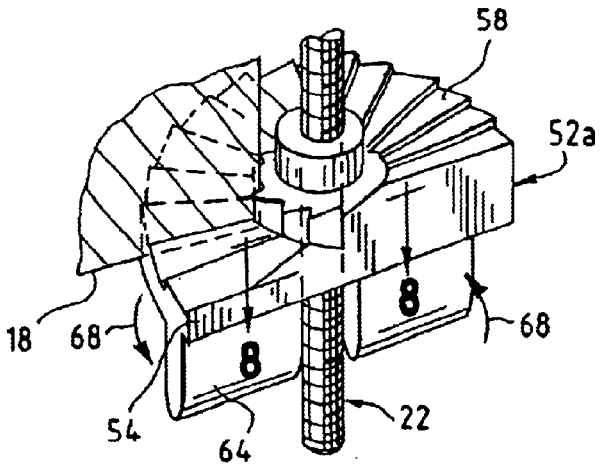
FIG. 7 is a perspective view, partly in section, of an alternative embodiment of the invention shown in FIG. 5 utilizing a form of linkage threadably engaged upon the stud attached to the sink perimeter flange.
Figure 8:
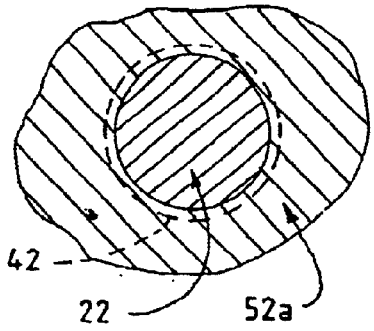
FIG. 8 is a sectional view, partly broken away and enlarged of a portion of the assembly shown in FIG. 7 taken in the direction of arrows 8—8 in FIG. 7.

The tubularly apertured section 62 of link 52 may also be internally threaded for obtaining a threaded engagement of the link on the stud 22. Such an engagement is shown in FIGS. 7 and 8. The link 52*a* is identical to link 52 except that the tubularly apertured section 62 is internally threaded and engages stud 22 as shown in FIG. 8. In that form, the link 52*a* does not need to be supported by a nut 50. Link 52*a* is merely threaded onto threads 42 to engage it onto stud 22 and rotated until the displacement means 58 engages the underside surface 18 of the countertop rim portion 12. Further rotation, as by forcing tabs 64 in the direction of arrows 68, forces the displacement means 58 simultaneously against the underside 18 of the countertop and also against the first end portion 54 of the link for drawing the stud downwardly and pulling a perimeter flange of a sink (not shown) into secure engagement with the upper side of a countertop rim portion (also not shown).

From all of the foregoing it will be evident that, although particular forms of the invention have been illustrated and described, nevertheless various modifications can be made without departing from the true spirit and scope of the invention. Accordingly, no limitation is intended by the foregoing description, and its full breadth is intended to be covered by the following claims.

I claim:

1. A clamp for securing a sink to a countertop having an aperture formed therein for receiving the sink and the sink having a perimeter flange overlying a rim portion of the countertop adjacent to the aperture, comprising a stud which includes a first end affixed to the perimeter flange adjacent an upper side of the countertop rim portion, a distal end adjacent an underside of the countertop rim portion, and a body portion extending between the first end and the distal end, a link intermediate the stud and the underside of the countertop rim portion including a first end portion extending toward the underside of the countertop rim portion, and a stud engagement portion slideably disposed on the body portion of the stud, and displacement means on the first end portion of the link simultaneously moveable against the underside of the countertop and the first end portion of the link for drawing the perimeter flange of the sink into secure engagement with the upper side of the countertop rim portion as the displacement means is moved.

2. The clamp of claim 1 in which the displacement means includes a threaded member on the first end portion of the link rotatively moveable against the underside of the countertop rim portion.

3. The clamp of claim 2 in which the first end portion of the link includes an internally threaded aperture and the threaded member includes an externally threaded bolt extending through and movable in the aperture to engage the underside of the countertop rim portion.

4. The clamp of claim 3 in which the body portion of the stud is provided with an engagement surface arranged to engage and hold the stud engagement portion of the link.

5. The clamp of claim 4 in which the stud engagement portion of the link is provided with an aperture having internal walls disposed about the body portion of the stud.

6. The clamp of claim 5 in which a stop member is disposed on the body portion of the stud and adjacent the aperture formed in the link.

7. The clamp of claim 1 in which the displacement means includes a circumferentially ascending surface portion on a washer mounted on the body portion of the stud.

8. The clamp of claim 7 in which the washer includes a centrally located core portion having a tubularly apertured stud engagement section mounted on and rotatable about the body portion of the stud.

9. The clamp of claim 8 in which a stop member is disposed on the body portion of the stud adjacent to the core portion of the washer.

10. A sink mounting assembly in a countertop comprising, in combination, a countertop member provided with a surface portion for accepting the installation of a sink which includes an aperture formed in the surface portion, and a countertop rim portion adjacent the aperture in the surface portion, a perimeter flange on a sink arranged to overlie the countertop rim portion when the sink is disposed in the aperture, a plurality of studs depending from the perimeter flange through the aperture in the countertop, each stud including a first end affixed to the perimeter flange adjacent an upper side of the countertop rim portion, a distal end adjacent an underside of the countertop rim portion, and a body portion extending between the first end and the distal end, a link intermediate the stud and the underside of the countertop rim portion including a first end portion extending toward the underside of the countertop rim portion, and a stud engagement portion slideably disposed on the body portion of the stud, and displacement means on the first end portion of the link simultaneously moveable against the underside of the countertop and the first end portion of the link for drawing the perimeter flange of the sink into secure engagement with the upper side of the countertop rim portion as the displacement means is moved.

* * * * *